US011016421B1

(12) United States Patent
Meguro et al.

(10) Patent No.: US 11,016,421 B1
(45) Date of Patent: May 25, 2021

(54) BELT POSITIONING STRUCTURE, BELT ROLLER UNIT, AND IMAGE FORMING APPARATUS

(71) Applicant: TOSHIBA TEC KABUSHIKI KAISHA, Tokyo (JP)

(72) Inventors: Takehiro Meguro, Hiratsuka Kanagawa (JP); Yoshiki Kogiso, Numazu Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/824,733

(22) Filed: Mar. 20, 2020

(51) Int. Cl.
*G03G 15/16* (2006.01)
*G03G 15/01* (2006.01)

(52) U.S. Cl.
CPC ..... *G03G 15/1615* (2013.01); *G03G 15/0189* (2013.01); *G03G 2215/0129* (2013.01)

(58) Field of Classification Search
None
See application file for complete search history.

(56) References Cited

U.S. PATENT DOCUMENTS 6,363,228 B1 * 3/2002 Ream ..... G03G 15/1615 399/121
2016/0313677 A1 10/2016 Oyama

FOREIGN PATENT DOCUMENTS

JP 2001163424 A * 6/2001
JP 2001163424 A * 8/2011

OTHER PUBLICATIONS

JP_2001163424_A_T MachineTranslation, Japan, 2001, Kuriki.*

* cited by examiner

*Primary Examiner* — Victor Verbitsky
(74) *Attorney, Agent, or Firm* — Amin, Turocy & Watson, LLP

(57) ABSTRACT

According to one embodiment, a belt positioning structure includes a belt roller around which an endless belt is wound. The belt comprises a belt-side positioning component curbing position aberration from the belt roller in a roller shaft direction. The belt roller comprises a roller-side positioning component curbing position aberration of the belt in a belt shaft direction. The roller-side positioning component comprises a regulation plate formed along a virtual tapered surface that has a diameter on one side in the roller shaft direction larger than a diameter on an opposite side of the regulation plate. The regulation plate comprises a movement regulation component that regulates movement of the belt-side positioning component to the one side of the belt-side positioning component in the roller shaft direction and strengthens a movement regulation force to the one side of the belt-side positioning component in the roller shaft direction.

17 Claims, 7 Drawing Sheets

BELT POSITIONING STRUCTURE, BELT ROLLER UNIT, AND IMAGE FORMING APPARATUS

FIELD

Embodiments described herein relate generally to a belt positioning structure, a belt roller unit, and an image forming apparatus.

BACKGROUND

There are image forming apparatuses such as multi-function peripherals (MFP), printers, and copy machines. An image forming apparatus transfers a toner image to an endless transfer belt to transfer the toner image to a recording medium such as a sheet.

The transfer belt includes a rib curbing belt bias in an inner circumferential surface in some cases. A roller around which the transfer belt is wound includes a regulation plate with which the rib can come into contact in some cases. The regulation plate forms a slope surface with which the rib can come into contact and the slope surface causes an action of returning the rib and further the transfer belt to a regular position. Thus, it is possible to reduce skewing of the transfer belt.

When a transfer belt is considerably skewed, a force of belt bias exceeds a regulation force returning a rib to a regulation position because of a slope surface of a regulation plate in some cases. In these cases, the rib sits on the slope surface of the regulation plate, but the rib soon returns to the regulation position because of the regulation force of the slope surface while the rib comes into contact with the slope surface. However, when the rib sits on a cylindrical belt-wound surface beyond the slope surface, the regulation force disappears because of the slope surface. In this case, the rib and further the transfer belt may enter a falling state in which the transfer belt does not return to the regulation position.

DETAILED DESCRIPTION

In general, according to one embodiment, a belt positioning structure, a belt roller unit, and an image forming apparatus include an endless belt and a belt roller around which the belt is wound. The belt includes a belt-side positioning unit curbing position aberration from the belt roller in a roller shaft direction. The belt roller includes a roller-side positioning unit curbing position aberration of the belt in a belt shaft direction in cooperation with the belt-side positioning unit. The roller-side positioning unit includes a regulation plate formed along a virtual tapered surface that has a larger diameter on one side in the roller shaft direction. The regulation plate can bring the belt-side positioning unit to come into contact from the other side in the roller shaft direction to regulate movement of the belt-side positioning unit to the one side of the belt-side positioning unit in the roller shaft direction. The regulation plate includes a movement regulation unit that has a regulation shape depressed or bulged with respect to the virtual tapered surface and strengthens a movement regulation force to the one side of the belt-side positioning unit in the roller shaft direction.

Hereinafter, a belt positioning structure 30, a belt roller unit 31, and an image forming apparatus 1 according to an embodiment will be described with reference to the drawings.

Figure 1:
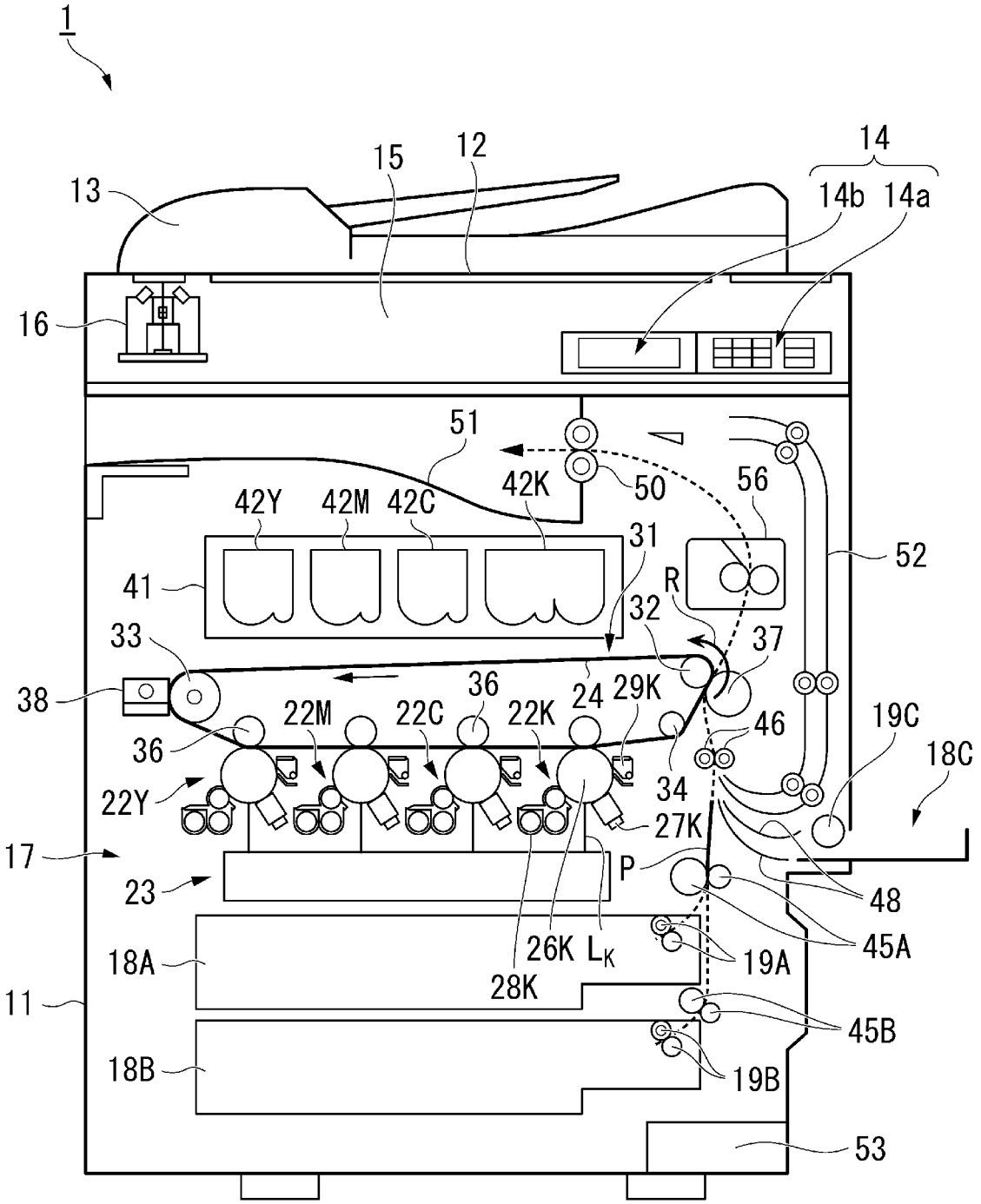
FIG. 1 is a schematic diagram illustrating an overall configuration example of an image forming apparatus according to an embodiment.

FIG. 1 is a schematic diagram illustrating an overall configuration example of the image forming apparatus 1 according to an embodiment.

In FIG. 1, the image forming apparatus 1 is, for example, a multi-function peripheral (MFP), a printer, or a copy machine. In the following description, the image forming apparatus 1 which is an MFP will be described as an example.

A configuration of the image forming apparatus 1 is not particularly limited. For example, the image forming apparatus 1 has a body 11. A document platen 12 that has a transparent glass is provided in an upper portion of the body 11. An automatic document feeder (ADF) 13 is provided on the document platen 12. An operation unit 14 is provided in an upper portion of the body 11. The operation unit 14 includes an operation panel 14*a* that has various keys and a touch panel type operation display unit 14*b*.

A scanner unit 15 is provided in a lower portion of the ADF 13. The scanner unit 15 reads a document fed by the ADF 13 and a document placed on the document platen 12. The scanner unit 15 generates image data of a document. For example, the scanner unit 15 includes an image sensor 16. For example, the image sensor 16 may also be a contact type image sensor. The image sensor 16 is moved along the document platen 12 when an image of a document placed on the document platen 12 is read.

A feeding cassette 18A (18B) includes a feeding mechanism 19A (19B). The fact that "the feeding cassette 18A (18B) includes the feeding mechanism 19A (19B)" means both the fact that the feeding cassette 18A includes the feeding mechanism 19A and the fact that the feeding cassette 18B includes the feeding mechanism 19B. The same applies in the following description.

The feeding mechanism 19A (19B) extracts a sheet P (a sheet-like recording medium such as paper) from the feeding cassette 18A (18B) one by one and sends the sheet P along a transport path of the sheet P. For example, the feeding mechanism 19A (19B) may include a pickup roller, a separating roller, and a feeding roller.

A manual feeding unit 18C includes a manual feeding mechanism 19C. The manual feeding mechanism 19C extracts the sheet P from the manual feeding unit 18C one by one and sends the sheet P along a transport path.

A printer unit (image forming unit) 17 forms an image on the sheet P based on image data read by the scanner unit 15 or image data generated by a personal computer or the like. The printer unit 17 is, for example, a tandem type color printer.

The printer unit 17 includes image forming units 22Y, 22M, 22C, and 22K of yellow (Y), magenta (M), cyan (C), and black (K) corresponding to color separation components of a color image, an exposure unit 23, and an intermediate transfer belt 24.

The configuration of the printer unit 17 is not limited thereto. The printer unit 17 may not include two or three image forming units. Alternatively, the printer unit 17 may include five or more image forming units.

Although not illustrated, the exposure unit 23 includes a light source, a polygon mirror, an f-O lens, and a reflection mirror. The exposure unit 23 irradiates the surfaces of photosensitive drums of the image forming units 22Y, 22M, 22C, and 22K with exposure light based on the image data.

Configurations of the image forming units 22Y, 22M, 22C, and 22K are the same except that the color of toner is different. As the toner, either normal color toner or decolorable toner may be used. Here, the decolorable toner is toner that becomes transparent when the toner is heated at a temperature equal to or greater than a given temperature. The image forming apparatus 1 may be the image forming apparatus 1 that can use decolorable toner or may be the image forming apparatus 1 that may not use decolorable toner.

The intermediate transfer belt 24 is an endless belt. The intermediate transfer belt 24 is suspended around a secondary transfer backup roller 32, a cleaning backup roller 33, and a tension roller 34. In the embodiment, the intermediate transfer belt 24 goes around (is rotatably driven) by rotatably driving the secondary transfer backup roller 32. An arrow R in the drawing indicates a driving direction (rotational direction) of the secondary transfer backup roller 32.

The image forming units 22Y, 22M, 22C, and 22K, a secondary transfer roller 37, and a belt cleaning mechanism 38 are disposed around the intermediate transfer belt 24. On the inner circumference side of the intermediate transfer belt 24, a plurality of primary transfer rollers 36 are disposed to face the image forming units 22Y, 22M, 22C, and 22K.

The printer unit 17 according to the embodiment includes the belt roller unit 31 that can be detachably mounted (exchanged) on a body portion of the printer unit 17. The belt roller unit 31 includes the intermediate transfer belt 24, the secondary transfer backup roller 32, the cleaning backup roller 33, the tension roller 34, and the plurality of primary transfer rollers 36.

Hereinafter, a common configuration of the image forming units 22Y, 22M, 22C, and 22K will be described giving an example of the image forming unit 22K.

The image forming unit 22K includes a photoreceptor 26K, a charger 27K, a developer 28K, and a cleaner 29K.

The photoreceptor 26K is formed in a drum shape. An electrostatic latent image such as text or an image is formed using exposure light LK on the surface of the photoreceptor 26K. The charger 27K charges the surface of the photoreceptor 26K. The developer 28K supplies toner to the surface of the photoreceptor 26K and develops the electrostatic latent image. The cleaner 29K cleans the surface of the photoreceptor 26K.

The primary transfer roller 36 of the image forming unit 22K forms a primary transfer nip with the photoreceptor 26K with the intermediate transfer belt 24 pinched therebetween. A light source (not illustrated) is connected to the primary transfer roller 36. At least one of a predetermined direct-current voltage (DC) and an alternating-current voltage (AC) is applied to the primary transfer roller 36.

The secondary transfer roller 37 forms a secondary transfer nip with the secondary transfer backup roller 32 with the intermediate transfer belt 24 pinched therebetween. Like the primary transfer roller 36, a light source (not illustrated) is connected to the secondary transfer roller 37. At least one of a predetermined direct-current voltage (DC) and an alternating-current voltage (AC) is applied to the secondary transfer roller 37.

In transfer in the image forming apparatus 1, there are a primary transfer process and a secondary transfer process. In the primary transfer process, toner images formed on the photoreceptors 26 of the image forming units 22Y, 22M, 22C, and 22K are transferred to the intermediate transfer belt 24. In the secondary transfer process, the toner images transferred to the intermediate transfer belt 24 are transferred (printed) to the sheet P which is a recording medium.

The belt cleaning mechanism 38 includes a cleaning brush and a cleaning blade (of which reference numerals are not illustrated) disposed to come into contact with the intermediate transfer belt 24. A waste toner transport hose (not illustrated) extends from the belt cleaning mechanism 38 and is connected to a waste toner receiver (not illustrated).

A supply unit 41 is disposed above the image forming units 22Y, 22M, 22C, and 22K. The supply unit 41 supplies toner to each of the image forming units 22Y, 22M, 22C, and 22K. The supply unit 41 includes toner cartridges 42Y, 42M, 42C, and 42K. The toner cartridges 42Y, 42M, 42C, and 42K accommodate yellow toner, magenta toner, cyan toner, and black toner, respectively.

In the toner cartridges 42Y, 42M, 42C, and 42K, indicators (not illustrated) detected by the types of accommodated toner by a main control unit 53 to be described below are provided. The indicators include color information of the toner of at least the toner cartridges 42Y, 42M, 42C, and 42K and information for identifying whether the toner is normal toner or decolorable toner.

Supply paths (not illustrated) are provided between developers corresponding to the toner cartridges 42Y, 42M, 42C, and 42K. The toner is supplied to the corresponding developers from the toner cartridges 42Y, 42M, 42C, and 42K via the supply paths.

A feeding roller 45A and a resist roller 46 are provided on a transport path reaching from the feeding cassette 18A to the secondary transfer roller 37. The feeding roller 45A transports the sheet P extracted from the feeding cassette 18A by the feeding mechanism 19A. The resist roller 46 arranges a position of the tip of the sheet P fed from the feeding roller 45A at a mutual contact position. The resist roller 46 transports the sheet P to the secondary transfer nip.

A feeding roller 45B is provided on a transport path reaching from the feeding cassette 18B to the feeding roller 45A. The feeding roller 45B transports the sheet P extracted from the feeding cassette 18B by the feeding mechanism 19B toward the feeding roller 45A.

A transport guide 48 forms a transport path between the manual feeding mechanism 19C and the resist roller 46. The manual feeding mechanism 19C transports the sheet P extracted from the manual feeding unit 18C toward the transport guide 48. The sheet P moving along the transport guide 48 arrives at the resist roller 46.

A fixing unit (fixing device) 56 is disposed downstream (on an upper side of the illustration) of the secondary transfer roller 37 in a transport direction of the sheet P.

A transport roller 50 is disposed downstream (on an upper left side of the illustration) of the fixing unit 56 in the transport direction of the sheet P. The transport roller 50 discharges the sheet P to a discharge unit 51.

A reverse transport path 52 is disposed upstream (on a right side of the illustration) of the fixing unit 56 in the transport direction of the sheet P. The reverse transport path 52 reverses the sheet P and guides the sheet P toward the secondary transfer roller 37. The reverse transport path 52 is used when duplex printing is performed.

The image forming apparatus 1 includes the main control unit 53 that controls the entire image forming apparatus 1. The main control unit 53 includes a central processing unit (CPU) and a memory.

The fixing unit 56 includes a fixing belt (belt) and a pressurization roller (roller), and a heater (heating unit) (none of which is illustrated). The fixing belt and the pressurization roller are disposed in parallel. The pressurization roller is pressurized to the fixing belt side by a pressurization unit (not illustrated). A nip in which the sheet P is pinched is formed in a portion in which the pressurization roller comes into pressure contact with the fixing belt.

The pressurization roller is rotatably driven by a driving source such as a motor (not illustrated). When the pressurization roller is rotatably driven, a driving force of the pressurization roller delivers to fixing belt in the nip and the fixing belt is driven and rotated. The sheet P pinched in the nip is transported to a downstream side of the transport direction by the rotation of the pressurization roller and the fixing belt. The fixing belt is heated by the heater and the toner image transferred to the sheet P is fixed to the sheet P by the heat and the pressure of the pressurization roller. After an image is formed, the sheet P is discharged to the discharge unit 51.

When a printing operation is performed, the intermediate transfer belt 24 may be skewed to run obliquely in a regular circumferential direction or may be biased to one side in a roller shaft direction in some cases. Such an event may cause excessive input or deformation to the intermediate transfer belt 24, and thus there is concern of the intermediate transfer belt 24 being damaged or falling. Therefore, on both sides of the intermediate transfer belt 24 in a belt width direction (roller shaft direction), the belt positioning structure 30 to be described below is provided to curb the bias of the intermediate transfer belt 24.

Figure 2:
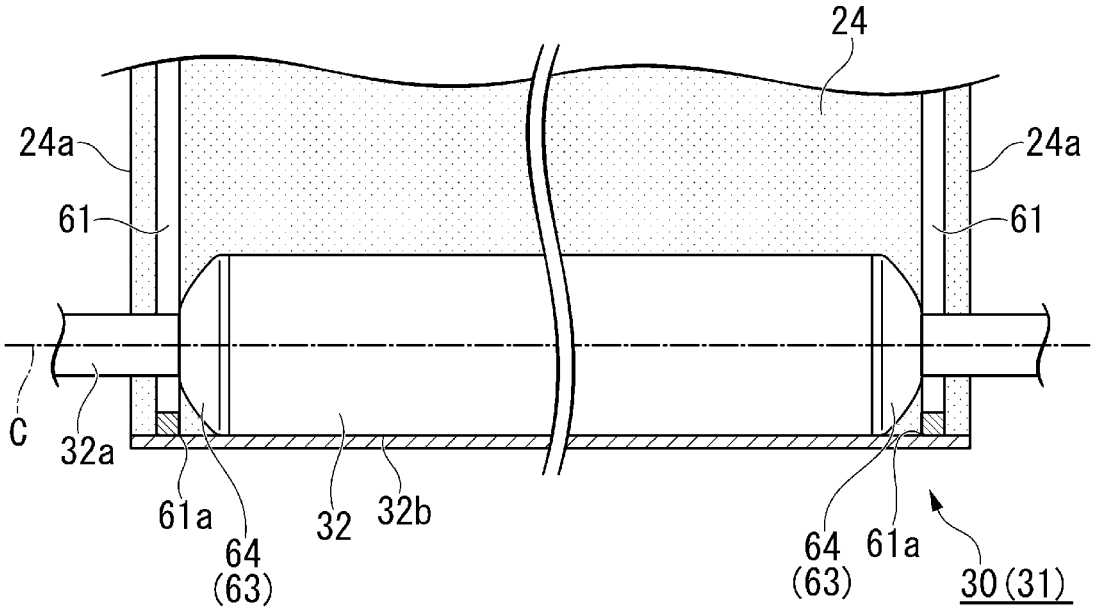
FIG. 2 is a plan view illustrating a configuration example of a transfer roller.
Figure 3:
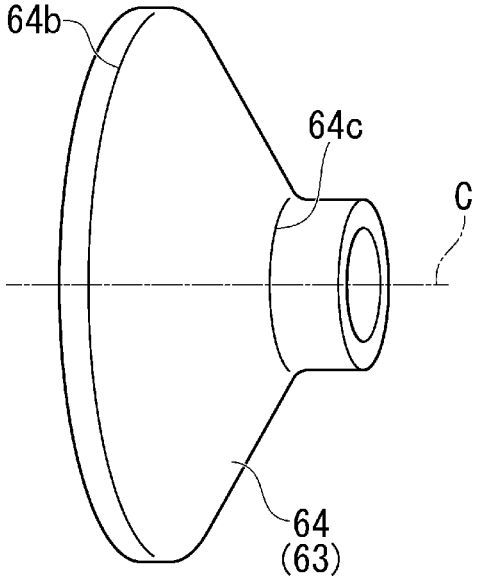
FIG. 3 is a perspective view illustrating a configuration example of a regulation plate of a transfer roller according to a comparative example.
Figure 4:
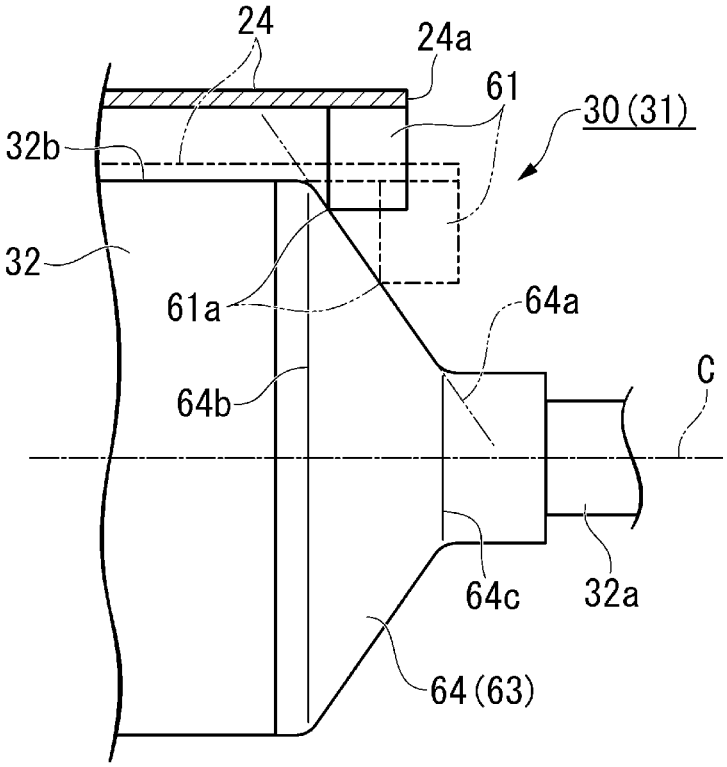
FIG. 4 is a front view illustrating an action of the regulation plate.

As illustrated in FIGS. 2 to 4, the belt positioning structure 30 includes belt-side positioning units 61 provided on inner circumferential surfaces of the intermediate transfer belt 24 on both sides in the width direction and roller-side positioning units 63 provided at ends of the secondary transfer backup roller 32 in a shaft direction. In the drawing, reference sign 32*a* denotes a support shaft of the secondary backup roller 32 and reference sign C denotes a central shaft line of the secondary transfer backup roller 32.

The belt-side positioning units 61 are ribs (projections) that extend in a cross-sectional rectangular shape in the longitudinal direction of the intermediate transfer belt 24. For example, the belt-side positioning units 61 are formed of elastic members such as synthetic rubber separate from the intermediate transfer belt 24. The belt-side positioning units 61 are fixed to the inner circumferential surfaces of the intermediate transfer belt 24 by adhesion and can go around integrally with the intermediate transfer belt 24. The belt-side positioning units 61 are disposed inner sides of an outside edge 24*a* in the width direction of the intermediate transfer belt 24. Thus, even when pasting positions of the belt-side positioning units 61 deviate, sticking-out of the belt-side positioning units 61 to the outside in the belt width direction is curbed.

The roller-side positioning unit 63 includes a regulation plate 64 that has a larger diameter as the regulation plate 64 is located closer to the middle side (one side) in the roller shaft direction. The regulation plate 64 has a tapered shape that has a larger diameter as the regulation plate is located closer to the middle side in the roller shaft direction. In the drawing, reference sign denotes a virtual tapered surface 64*a* (inclination surface) serving as a reference surface of the tapered shape of the regulation plate 64. The regulation plate 64 can come into contact with the belt-side positioning unit 61 from the outside (the other side) in the roller shaft direction. The regulation plate 64 is located closer to the middle side in the roller shaft direction than the belt-side positioning unit 61. For example, the regulation plate 64 may have a tapered shape with a larger diameter as the regulation plate is located closer to the middle side in the roller shaft direction. In this case, the regulation plate 64 brings the belt-side positioning unit 61 to come into contact from the middle side in the roller shaft direction.

By driving the intermediate transfer belt 24 by the intermediate transfer belt 24 including the regulation plates 64, movement of the belt-side positioning units 61 to the middle side in the roller shaft direction is regulated. Thus, sitting of the belt-side positioning units 61 on the regulation plates 64 is regulated, and thus bias of the intermediate transfer belt 24 is regulated. In each drawing, a state of the sitting of the belt-side positioning units 61 on the regulation plates 64 is indicated by a chain line. The regulation plates 64 produces an action of returning the belt-side positioning units 61 and further the intermediate transfer belt 24 to a normal position (trajectory) even when the belt-side positioning units 61 sit on the regulation plates 64.

Figure 5:
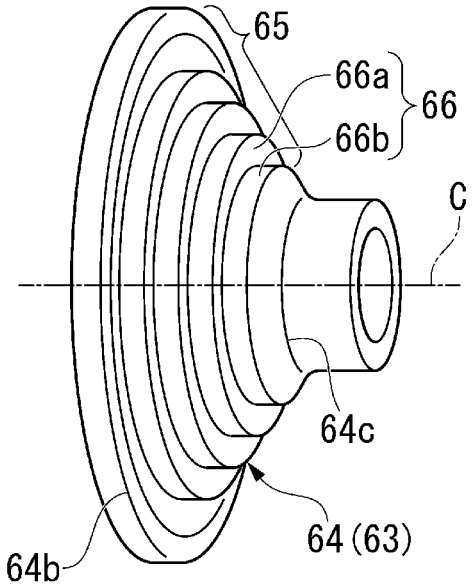
FIG. 5 is a perspective view illustrating a configuration example of a regulation plate of a transfer roller according to an embodiment.
Figure 6:
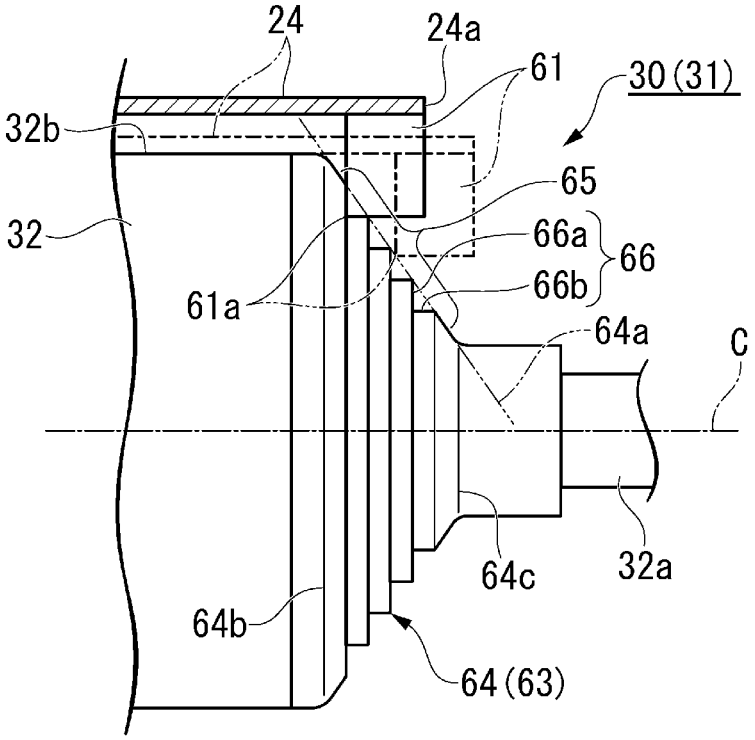
FIG. 6 is a front view illustrating an action of the regulation plate.

FIGS. 2 to 4 illustrate a comparative example of the embodiment. On the other hand, as illustrated in FIGS. 5 and 6, the regulation plate 64 according to the embodiment includes a movement regulation unit 65 that strengthens a movement regulation force to the middle side of the belt-side positioning unit 61 in the roller shaft direction. The movement regulation unit 65 is provided across the regulation plate 64 between an inner circumference 64*b* and an outer circumference 64*c* of the entire regulation plate 64. A margin in which the movement regulation unit 65 is not provided in at least one of the inner circumference 64*b* and the outer circumference 64*c* of the regulation plate 64 may be set. The movement regulation unit 65 has regulation shapes 66 depressed on the virtual tapered surface 64*a*. In the movement regulation unit 65, the plurality of circular regulation shapes 66 in a roller shaft direction are formed in a concentric shape. The movement regulation unit 65 is formed in a stepped shape on the virtual tapered surface 64*a* forming a straight line shape (or a gentle curved shape) on a cross-sectional surface in the roller circumference direction.

In each regulation shape 66, an erect surface 66*a* with a larger angle in the roller shaft direction than the virtual tapered surface 64*a* is formed. The erect surface 66*a* according to the embodiment is formed to be parallel to a roller diameter direction (to be orthogonal to the roller shaft direction).

Each regulation shape 66 includes the erect surface 66*a* formed in the roller diameter direction and a bottom surface 66*b* formed in the roller shaft direction. Each regulation shape 66 is a groove formed in an L shape on a cross-sectional surface in the roller shaft direction.

The regulation shape 66 according to the embodiment is formed in a depressed shape which does not protrude from the virtual tapered surface 64*a*, but may be formed in a bulged shape protruding from the virtual tapered surface 64*a*. At least a part of the regulation shape 66 may be formed in a bulged shape protruding from the virtual tapered surface 64*a*. In the regulation shape 66, an uneven shape may be combined on the virtual tapered surface 64*a*. The erect surface 66*a* according to the embodiment is formed to be parallel to the roller diameter direction, but an embodiment is not limited thereto. The erect surface 66*a* may be a surface with a larger angle in the roller shaft direction than the virtual tapered surface 64*a*.

The erect surface 66*a* is a surface that comes into contact with the rib (the belt-side positioning unit 61) which is to move along the virtual tapered surface 64*a* in the roller shaft direction. The erect surface 66*a* may be more erect than the virtual tapered surface 64*a* so that movement of the belt-side positioning unit 61 which is to move along the virtual tapered surface 64*a* is curbed. The erect surface 66*a* according to the embodiment is erect until the erect surface 66*a* is in the roller diameter direction (until the erect surface 66*a* becomes orthogonal to the roller shaft direction), and thus an advantage of moving the belt-side positioning unit 61 is high.

Since the plurality of regulation shapes 66 are formed in a stepped shape, the height of the erect surface 66*a* of each regulation shape 66 is restricted. In the rib of the belt-side positioning unit 61, only the periphery of a corner 61*a* on the tip side comes into contact with the erect surface 66*a* of the regulation shape 66. For example, when the secondary transfer backup roller 32 has a flat portion orthogonal in the roller shaft direction instead of the regulation plate 64, there is the following problem. When the side surface of the rib of the belt-side positioning unit 61 comes into contact with the flat portion, there is concern of the rib sitting on the secondary transfer backup roller 32 at once. Such an event is curbed when the movement regulation unit 65 in the stepped shape regulates the sitting of the rib step by step.

When the belt-side positioning units 61 sit on the regulation plate 64, excessive input or deformation occurs in the intermediate transfer belt 24 in some cases. Therefore, by providing the movement regulation unit 65 in the regulation plate 64, the movement regulation force against the belt-side positioning units 61 is strengthened. In the movement regulation unit 65, the movement regulation force against the belt-side positioning units 61 is stronger than when the regulation plate 64 is formed in the flat shape following the virtual tapered surface 64*a*. The movement regulation unit 65 has a strong regulation force against movement of the belt-side positioning units 61 to the middle side and the outer circumference side in the roller shaft direction (the sitting on the regulation plate 64).

Thus, even when a large bias force occurs in the intermediate transfer belt 24, a falling state of the intermediate transfer belt 24 is curbed. The intermediate transfer belt 24 enters the falling state when the belt-side positioning unit 61 pushes up from the regulation plate 64 and sits on the outer circumferential surface (a belt-winding surface 32*b*). By forming the movement regulation unit 65 in the stepped shape in the regulation plate 64, the movement regulation force against the belt-side positioning unit 61 is strengthened. Thus, it is possible to improve reliability of belt positioning.

The regulation plates 64 are provided on both sides in the roller shaft direction of the secondary transfer backup roller 32. The regulation plate 64 is formed to have a larger diameter as the regulation plate 64 is located closer to the middle side in the roller shaft direction. The regulation plates 64 are provided on both sides of a cylindrical outer surface (the belt-winding surface 32*b*) in the secondary transfer backup roller 32. Each regulation plate 64 can come into contact with each belt-side positioning unit 61 provided on both sides in the width direction of the intermediate transfer belt 24 from the outside in the roller shaft direction.

In this way, the intermediate transfer belt 24 is positioned on both sides in the belt width direction (the roller shaft direction). Each regulation plate 64 guides each belt-side positioning unit 61 to the outside in the roller shaft direction and regulates movement of each belt-side positioning unit 61 to the middle side in the roller shaft direction. Thus, bias of the intermediate transfer belt 24 in the roller shaft direction is curbed. Slackening of the intermediate transfer belt 24 in the roller shaft direction (folding on the belt-winding surface 32*b*) is curbed.

The regulation shape 66 is a groove that has a cross-sectional L shape and includes the erect surface 66*a* extending in the roller diameter direction and the bottom surface 66*b* extending from a base end of the erect surface 66*a* to the outside in the roller shaft direction. Thus, the erect surface 66*a* in the roller diameter direction effectively regulates movement of the belt-side positioning unit 61 in the roller shaft direction. When the bottom surface 66*b* is in the roller shaft direction, it is easy for the regulation plate 64 to be formed in a punching shape in the roller shaft direction. Since the regulation shape 66 is considered to be the groove that has the cross-sectional L shape, the corner 61*a* of the belt-side positioning unit 61 in the cross-sectional rectangular shape is easily caught and movement of the belt-side positioning unit 61 is effectively regulated. By providing the roller-side positioning unit 63 in the driving roller, it is possible to actively position the intermediate transfer belt 24.

In such a configuration, it is possible to provide the belt positioning structure 30, the belt roller unit 31, and the image forming apparatus 1 in which the skewing of bias of the intermediate transfer belt 24 is curbed and damaging or falling the intermediate transfer belt 24 is curbed.

Figure 7:
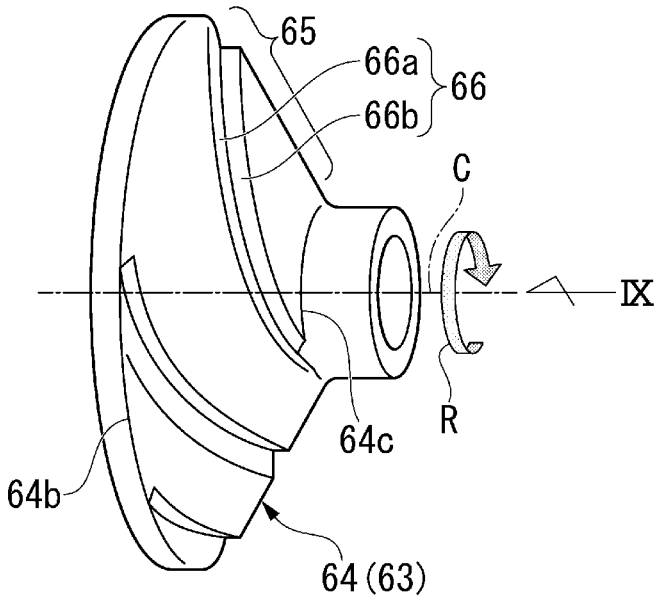
FIG. 7 is a perspective view illustrating a configuration example of a regulation plate of a transfer roller according to a second embodiment.
Figure 8A:
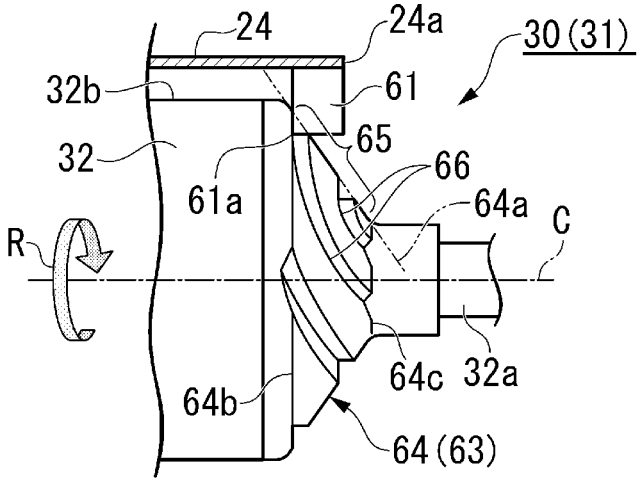
FIG. 8A is a front view illustrating a rib sitting on the regulation plate.
Figure 8B:
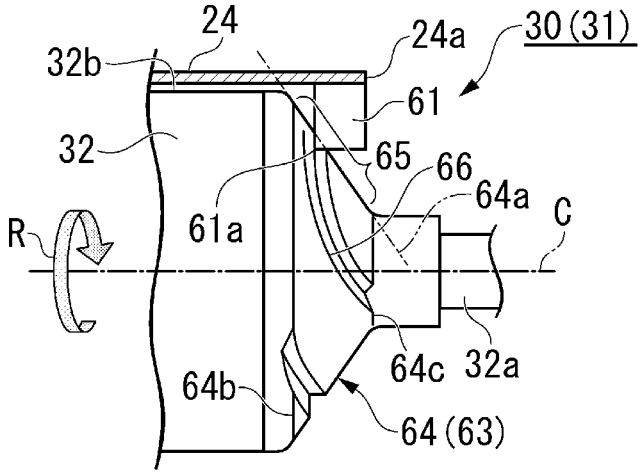
FIG. 8B is a front view illustrating the rib getting off from the regulation plate.
Figure 8C:
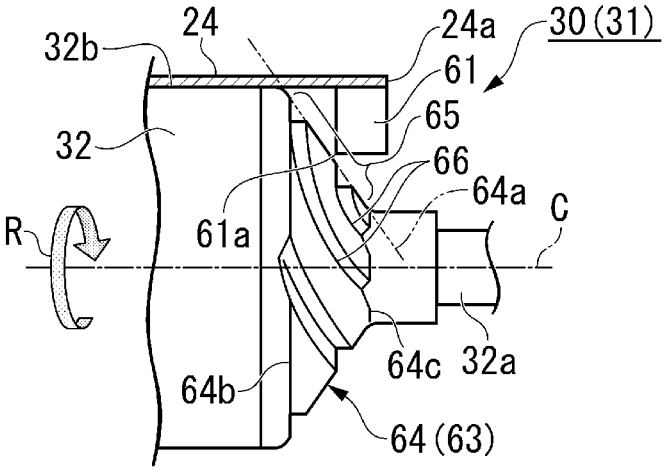
FIG. 8C is a front view illustrating the rib getting off from the regulation plate.
Figure 9:
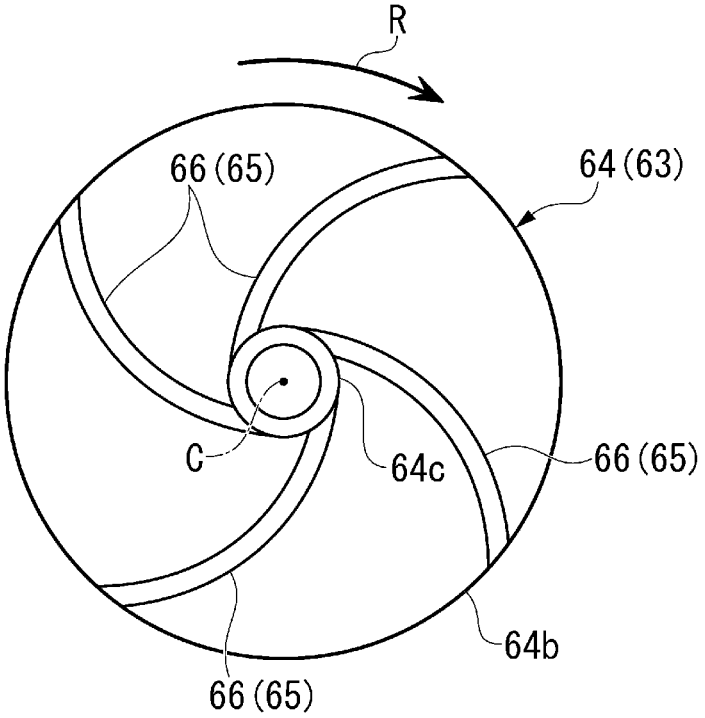
FIG. 9 is a diagram taken along the arrow IX of FIG. 7.

FIGS. 7 to 9 illustrate a second embodiment of the belt positioning structure 30. In the second embodiment, the regulation shape 66 is formed in a helical shape as a method of actively using the regulation shape 66 provided in the regulation plate 64.

A movement regulation unit 165 according to the second embodiment is provided in an entire region between the inner circumference 64*b* and the outer circumference 64*c* of the regulation plate 64. In the movement regulation unit 165, a regulation shape (helical shape) 166 depressed with respect to the virtual tapered surface 64*a* is formed. The helical shape 166 is a helical shape advancing to the outside in the roller shaft direction in a rotation direction R when the belt is driven. The helical shape 166 is a helical shape advancing from the outer circumference side (the middle side in the roller shaft direction) to the inner circumference side (the outside in the roller shaft direction) in the rotation direction reverse to the rotation direction R when the belt is driven.

The plurality of helical shapes 166 are provided. Each helical shape 166 forms an erect surface 166*a* with a larger angle in the roller shaft direction than the virtual tapered surface 64*a*. The erect surface 166*a* according to the embodiment is formed to be parallel to the roller diameter direction (to be orthogonal to the roller shaft direction).

Each helical shape 166 has the erect surface 166*a* formed in the roller diameter direction and a bottom surface 166*b* formed in the roller shaft direction. Each regulation shape 166 is a groove formed in an L shape on a cross-sectional surface in the roller shaft direction.

The helical shape 166 according to the embodiment is formed in a depressed shape which does not protrude from the virtual tapered surface 64*a*, but may be formed in a bulged shape protruding from the virtual tapered surface 64*a*. At least a part of the helical shape 166 may be formed in a bulged shape protruding from the virtual tapered surface 64*a*. In the helical shape 166, an uneven shape may be combined on the virtual tapered surface 64*a*. The erect surface 166*a* according to the embodiment is formed to be parallel to the roller diameter direction, but an embodiment is not limited thereto. The erect surface 166*a* may be a surface with a larger angle in the roller shaft direction than the virtual tapered surface 64*a*.

When the belt-side positioning unit 61 comes into contact with the helical shape 166, an action of not only simply regulating movement of the belt-side positioning unit 61 but also returning the belt-side positioning unit 61 to the outside in the roller shaft direction is produced. When the intermediate transfer belt 24 is biased in the roller shaft direction, the following event occurs. One belt-side positioning unit 61 is separated from the adjacent regulation plate 64, but the other belt-side positioning unit 61 moves along the regulation plate 64 and sits on the regulation plate 64.

When the belt-side positioning unit 61 sits on the regulation plate 64, the belt-side positioning unit 61 is caught by the helical shape 166. Therefore, further sitting is regulated. Since the helical shape 166 rotates in a driving direction R of the secondary transfer backup roller 32, the following action is produced. When the rotation of the helical shape 166 advances, the helical shape 166 advances to the outside (the inner circumference side) in the roller shaft direction. At this time, the belt-side positioning unit 61 caught by the helical shape 166 returns to the outside (the inner circumference side) in the roller shaft direction. That is, the helical shape 166 produces a force returning the belt-side positioning unit 61 and further the intermediate transfer belt 24 to a regular position.

Further, when the rotation of the secondary transfer backup roller 32 advances, the belt-side positioning unit 61 becomes away from the helical shape 166, but is in a slight contact with the helical shape 166. Thus, the contact of the belt-side positioning unit 61 to the helical shape 166 is substantially lost. At this time, the belt-side positioning unit 61 can maintain a shaft direction position before the sitting on the regulation plate 64. The intermediate transfer belt 24 can maintain a regular rotational position. By including the plurality of sets of the helical shapes 166, an action of returning the intermediate transfer belt 24 to the regular rotational position increases, thereby further improving reliability of belt positioning.

Figure 10:
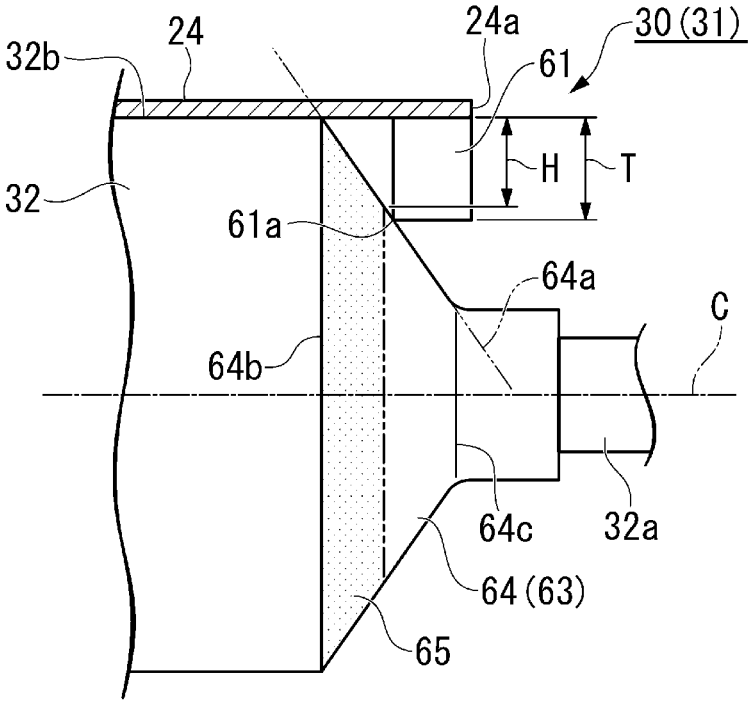
FIG. 10 is a front view illustrating a modification example of the regulation plate.

FIG. 10 illustrates a modification example of the second embodiment of the belt positioning structure 30. In the modification example, the movement regulation unit 165 is provided only on the outer circumference side avoiding the inner circumference side of the regulation plate 64.

The movement regulation unit 165 according to the modification example is formed on the inner circumference side from the roller outer circumferential surface within a range H of a width less than a protrusion height T of the belt-side positioning unit 61 in the roller diameter direction. Thus, in a state in which the belt-side positioning unit 61 does not sit on the regulation plate 64, the rib does not come into contact with the helical shape 166. Even when the belt-side positioning unit 61 comes into contact with the regulation plate 64, the rib does not come into contact with the helical shape 166.

A helical groove gives a returning force in the roller shaft direction to the corner 61*a* of the belt-side positioning unit 61 (the rib) when the belt-side positioning unit 61 comes into contact. Therefore, when the movement regulation unit 165 is formed in the entire region between the inner circumference 64*b* and the outer circumference 64*c* of the regulation plate 64, the rib continuously comes into contact with the helical groove on the inner circumference side. This event occurs, for example, when the intermediate transfer belt 24 tends to be biased to the belt roller unit 31. In this case, the helical groove continuously gives a movement force to the rib. Therefore, there is concern of uneven wear occurring in a portion of the belt-side positioning unit 61 coming into contact with the movement regulation unit 65.

The wear of the belt-side positioning unit 61 is undesirable due to the wear affecting a belt positioning force (a belt movement regulation force) of the belt-side positioning unit 61. In the modification example of FIG. 10, the belt-side positioning unit 61 does not come into contact with the helical shape 166 when the belt-side positioning unit 61 does not sit on the regulation plate 64 (in a normal operation of the belt roller unit 31). Only when the belt-side positioning unit 61 sits on the regulation plate 64, the belt-side positioning unit 61 comes into contact with the helical shape 166. Only when the belt-side positioning unit 61 sits on the regulation plate 64, the belt-side positioning unit 61 comes into contact with the helical shape 166 and returns to the shaft direction position before the movement (before the sitting). Therefore, it is possible to curb wear of the belt-side positioning unit 61 while improving reliability of belt positioning. An embodiment is not limited to a configuration in which the inner circumference side of the regulation plate 64 is formed to be flat in the modification example of FIG. 10. On the inner circumference side of the regulation plate 64, a shallower groove may be formed than on the outer circumference side. In the inner circumference side of the regulation plate 64, a movement force given to the rib may be less than in the outer circumference side.

According to at least one of the embodiments described above, in the belt positioning structure 30, the belt roller unit 31, and the image forming apparatus 1, the regulation plate 64 of the secondary transfer backup roller 32 includes the movement regulation unit 65 that has the depressed or bulged regulation shape 66, thereby improving reliability of belt positioning.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. A belt positioning structure, comprising:

an endless belt; and a belt roller around which the belt is wound, wherein the belt comprises a belt-side positioning component curbing position aberration from the belt roller in a roller shaft direction, the belt roller comprises a roller-side positioning component curbing position aberration of the belt in a belt shaft direction in cooperation with the belt-side positioning component, the roller-side positioning component comprises a regulation plate formed along a virtual tapered surface that has a diameter on one side in the roller shaft direction larger than a diameter on an opposite side of the regulation plate, and the regulation plate comprises a movement regulation component that brings the belt-side positioning component to come into contact from an outside in the roller shaft direction to regulate movement of the belt-side positioning component to the one side of the belt-side positioning component in the roller shaft direction and has a regulation shape depressed in or bulged out from the virtual tapered surface and strengthens a movement regulation force to the one side of the belt-side positioning component in the roller shaft direction, wherein the movement regulation component has a helical regulation shape inclined in a roller circumference direction, and wherein the regulation shape is a helical shape advancing to an outside in the roller shaft direction in a rotation direction when the belt is driven.

2. The structure according to claim 1, wherein the movement regulation component has a circle regulation shape in a roller circumference direction.

3. The structure according to claim 1, wherein the movement regulation component has a plurality of sets of the regulation shapes.

4. The structure according to claim 3, wherein the movement regulation component is positioned on an outer circumference side thereby avoiding an inner circumference side of the regulation plate.

5. The structure according to claim 1, wherein the regulation shape has an erect surface with a larger angle in the roller shaft direction than the virtual tapered surface.

6. The structure according to claim 1, wherein the regulation shape is a groove that has a cross-sectional L shape and comprises the erect surface extending in a roller diameter direction and a bottom surface extending from a base end of the erect surface to an outside in the roller shaft direction.

7. The structure according to claim 6, wherein the belt-side positioning unit comprises a projection that is provided on an inner circumferential surface of the belt and has a cross-sectional rectangular shape configured to contact the regulation plate.

8. A belt system, comprising:

a belt positioning structure comprising:

an endless belt; and a belt roller around which the belt is wound, wherein the belt comprises a belt-side positioning component curbing position aberration from the belt roller in a roller shaft direction, the belt roller comprises a roller-side positioning component curbing position aberration of the belt in a belt shaft direction in cooperation with the belt-side positioning component, the roller-side positioning component comprises a regulation plate formed along a virtual tapered surface that has a diameter on one side in the roller shaft direction larger than a diameter on an opposite side of the regulation plate, and the regulation plate comprises a movement regulation component that brings the belt-side positioning component to come into contact from an outside in the roller shaft direction to regulate movement of the belt-side positioning component to the one side of the belt-side positioning component in the roller shaft direction and has a regulation shape depressed in or bulged out from the virtual tapered surface and strengthens a movement regulation force to the one side of the belt-side positioning unit in the roller shaft direction; and an image forming device configured to transfer an image formed on the endless belt to a recording medium, wherein the belt system is detachably mounted on a body of the image forming device, wherein the movement regulation component has a helical regulation shape inclined in a roller circumference direction, and wherein the regulation shape is a helical shape advancing to an outside in the roller shaft direction in a rotation direction when the belt is driven.

9. The belt system according to claim 8, wherein the movement regulation component has a plurality of sets of the regulation shapes.

10. The belt system according to claim 9, wherein the movement regulation component is positioned on an outer circumference side thereby avoiding an inner circumference side of the regulation plate.

11. The belt system according to claim 8, wherein the regulation shape has an erect surface with a larger angle in the roller shaft direction than the virtual tapered surface.

12. The belt system according to claim 8, wherein the regulation shape is a groove that has a cross-sectional L shape and comprises the erect surface extending in a roller diameter direction and a bottom surface extending from a base end of the erect surface to an outside in the roller shaft direction.

13. The belt system according to claim 8, wherein the belt-side positioning component comprises a projection that is provided on an inner circumferential surface of the belt and has a cross-sectional rectangular shape configured to contact the regulation plate.

14. An image forming apparatus, comprising:

an image forming device having a belt positioning structure comprising:

an endless belt; and a belt roller around which the belt is wound, wherein the belt comprises a belt-side positioning component curbing position aberration from the belt roller in a roller shaft direction, the belt roller comprises a roller-side positioning component curbing position aberration of the belt in a belt shaft direction in cooperation with the belt-side positioning component, the roller-side positioning component comprises a regulation plate formed along a virtual tapered surface that has a diameter on one side in the roller shaft direction larger than a diameter on an opposite side of the regulation plate, and the regulation plate comprises a movement regulation component that brings the belt-side positioning component to come into contact from an outside in the roller shaft direction to regulate movement of the belt-side positioning component to the one side of the belt-side positioning component in the roller shaft direction and has a regulation shape depressed in or bulged out from the virtual tapered surface and strengthens a movement regulation force to the one side of the belt-side positioning unit in the roller shaft direction, wherein the image forming device transfers an image formed on the endless belt to a recording medium, wherein the movement regulation component has a helical regulation shape inclined in a roller circumference direction, and wherein the regulation shape is a helical shape advancing to an outside in the roller shaft direction in a rotation direction when the belt is driven.

15. The image forming apparatus according to claim 14, wherein the movement regulation component has a plurality of sets of the regulation shapes, and the movement regulation component is positioned on an outer circumference side thereby avoiding an inner circumference side of the regulation plate.

16. The image forming apparatus according to claim 14, wherein the regulation shape is a groove that has a cross-sectional L shape and comprises the erect surface extending in a roller diameter direction and a bottom surface extending from a base end of the erect surface to an outside in the roller shaft direction.

17. The image forming apparatus according to claim 16, wherein the belt side positioning unit comprises a projection that is provided on an inner circumferential surface of the belt and has a cross-sectional rectangular shape configured to contact the regulation plate.

* * * * *